US008459646B2

(12) United States Patent
Wolf

(10) Patent No.: US 8,459,646 B2
(45) Date of Patent: Jun. 11, 2013

(54) TABLE GAME AND METHOD OF PLAY

(76) Inventor: Kevin Wolf, Oviedo, FL (US)

( * ) Notice: Subject to any disclaimer, the term of this patent is extended or adjusted under 35 U.S.C. 154(b) by 336 days.

(21) Appl. No.: 12/886,194

(22) Filed: Sep. 20, 2010

(65) Prior Publication Data

US 2012/0068404 A1 Mar. 22, 2012

(51) Int. Cl.
*A63F 3/00* (2006.01)
*A63F 9/00* (2006.01)

(52) U.S. Cl.
USPC ..... 273/126 R; 273/126 A

(58) Field of Classification Search
USPC ..... 273/26 R, 126 A, 108, 118 R, 118 A, 273/119 R, 119 A, 129 R, 129 S, 129 T, 129 V, 273/129 W
See application file for complete search history.

(56) References Cited

U.S. PATENT DOCUMENTS 3,228,688 A * 1/1966 Dennison ..... 273/108.5
3,675,927 A * 7/1972 Gottlieb et al. ..... 273/119 A
3,722,888 A * 3/1973 Ducharme ..... 273/126 R
4,563,008 A * 1/1986 Fielden ..... 273/126 R
5,029,863 A * 7/1991 Krawczyk et al. ..... 273/125 R
5,372,364 A 12/1994 Arroyo
5,755,439 A * 5/1998 Turner ..... 273/126 R
5,788,231 A * 8/1998 To ..... 273/126 R
5,884,911 A 3/1999 Guridi
6,502,819 B2 * 1/2003 Rieber et al. ..... 273/126 R
7,156,395 B1 1/2007 Rosado-Galarza
7,222,851 B2 * 5/2007 Stromberg ..... 273/126 A
7,389,987 B1 * 6/2008 Paukert ..... 273/108.1

* cited by examiner

*Primary Examiner* — Nini Legesse

(74) *Attorney, Agent, or Firm* — Daniel Law Offices, P.A.; Jason T. Daniel, Esq.

(57) ABSTRACT

A table game has a plurality of pucks for sliding across a table top that is divided into an elongated runner section and a scoring section. Both the runner section and the scoring section have multiple bumpers for affecting the path of the pucks, and the scoring section has multiple scoring indicators representing different scores. Each player has a predetermined number of throws and once a set score is reached, a winner is crowned.

19 Claims, 6 Drawing Sheets

TABLE GAME AND METHOD OF PLAY

BACKGROUND

1. Field of the Invention

The present invention relates generally to a table game suitable for play by a wide variety of age groups.

2. Description of the Related Art

There are a number of known table games commercially available for play by adults and children alike. These games include, for example, table hockey, table soccer and foosball, among others. As the majority of commercially available games are stick and ball type games, few incorporate logic and mathematical skills, along with the physical activities of a user in order to determine the ultimate outcome.

Accordingly, it would be beneficial to provide a table game and a method of play which overcomes the deficiencies noted above and is appealing to a wide variety of age groups. It is also an objective of the invention to provide a game table which is simple and economical to manufacture.

SUMMARY OF THE INVENTION

The present invention is directed to a table game for combining logic, mathematic skills and the physical ability of a user to determine a winner. One embodiment of a table game can include a number of pucks for sliding across a table top that is divided into an elongated runner section and a scoring section. Both the runner section and the scoring section can include multiple bumpers for affecting the path of the pucks, and the scoring section can include multiple scoring indicators.

Another embodiment of the present invention can include a method of playing a table game including the features described above.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

A table game described herein as "Knockilus" incorporates an elongated playing surface having a plurality of pucks and obstacles in which the object of the game is to outscore an opponent by positioning your pucks in high scoring positions. As will be described below in more detail, this can be done in several manners such as blocking or knocking opposing pucks from the scoring area. The game is easy to play and can be enjoyed by players of almost any age.

Pucks

Figure 1:
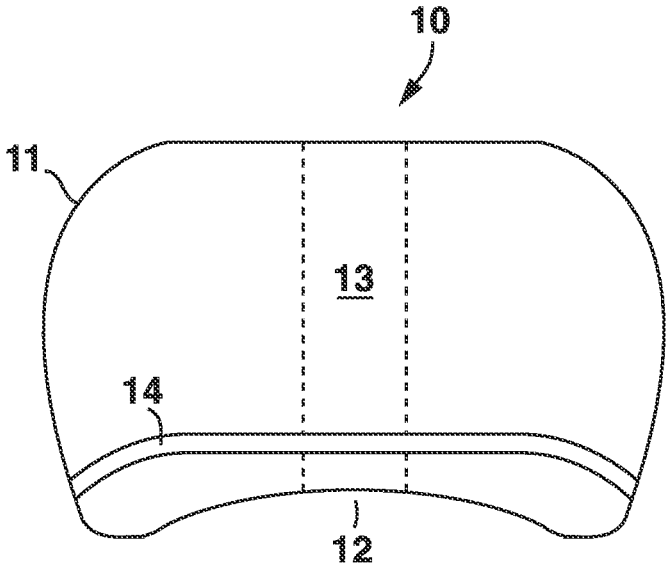
FIG. 1 illustrates one embodiment of a puck for use with the presently claimed invention.
Figure 1A:
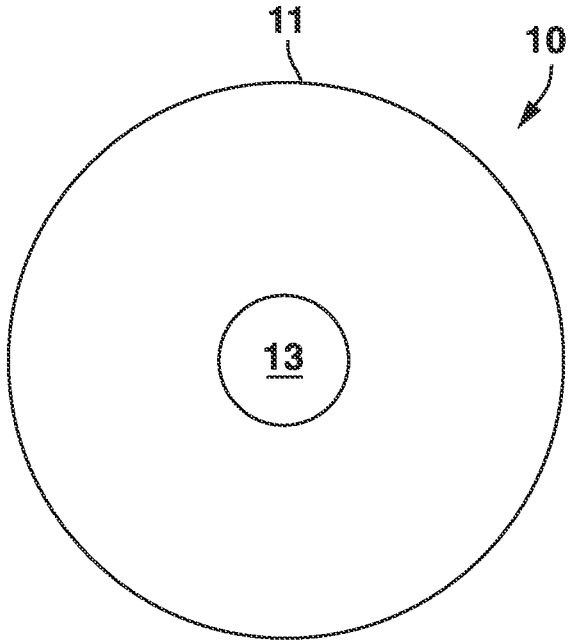
FIG. 1*a* illustrates a top view of the puck described in FIG. 1.

FIG. 1 illustrates one embodiment of a puck that can be used in conjunction with the presently claimed invention. As shown, puck 10 can include but is not limited to a circular member 11 having an indentation 12 at the bottom end thereof. Such an indentation, can allow a smaller portion of the puck to contact the surface area of the playing board in order to reduce friction. Additionally, puck 10 can further include a hole 13 (See FIG. 1*a*) extending through the center portion thereof. As will be explained below in greater detail, such a feature can allow the user to readily identify the scoring position of the puck in play. Moreover, puck 10 can also include one or more weighted inserts 14 for ensuring an optimal weight of the puck. In one embodiment, one or more inserts 14 can be incorporated into the construction of the puck and can further include a variety of different weight options suitable for players ranging from children to adults. Inserts 14, as described above can be constructed from virtually any known material having a high weight to size ratio such as metal, for example, and can be utilized to ensure the puck 10 has a sufficient weight and balance to glide across the playing board without overturning.

In one preferred embodiment, puck 10 can be constructed from hardened plastic, however other materials are also contemplated including, for example, injection molded plastic, nylon, teflon or other known materials.

Playing Table

Figure 2:
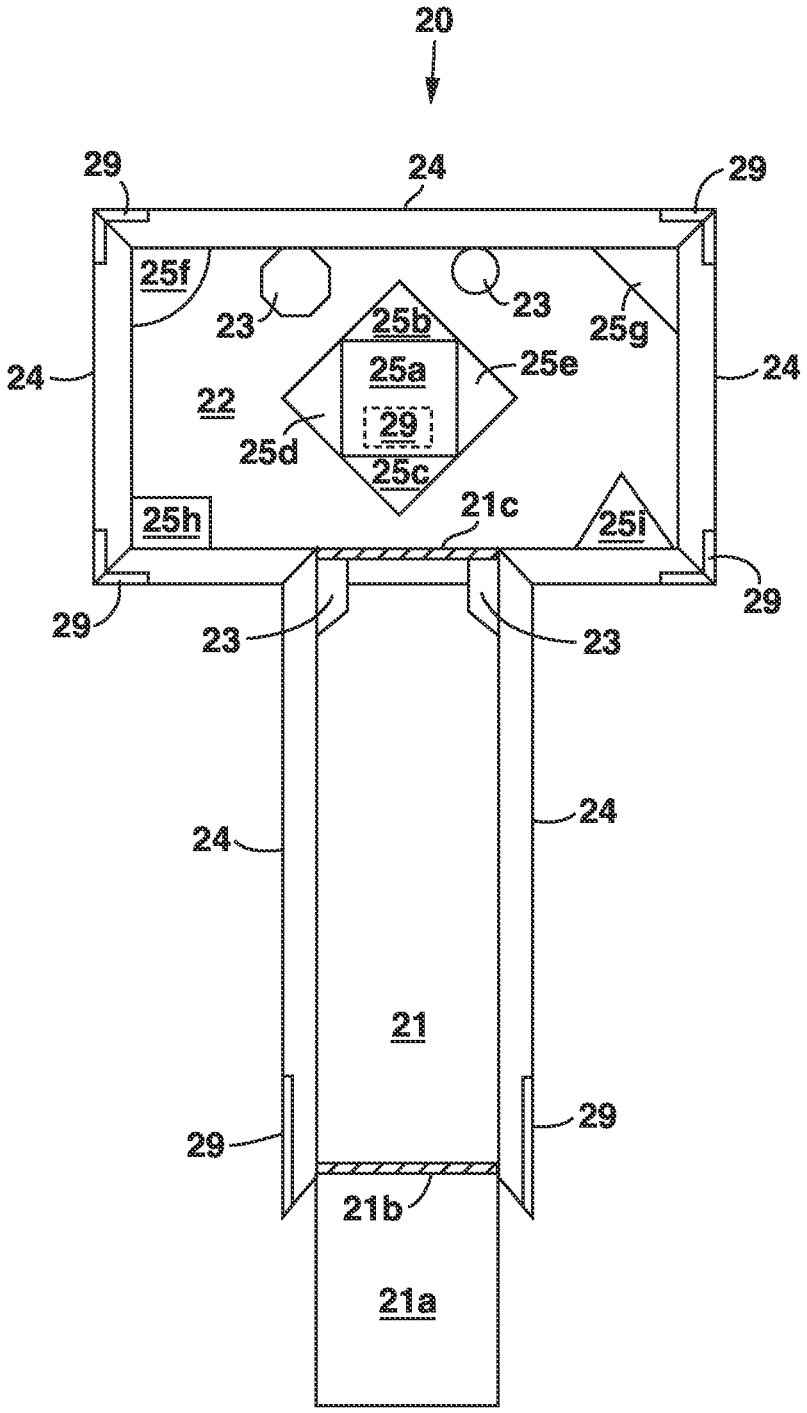
FIG. 2 illustrates a top view of a playing table according to one embodiment that is useful for understanding the inventive concepts described herein.

FIG. 2 illustrates one embodiment of a playing table 20 that is useful for understanding the inventive concepts described herein. As shown, table 20 can include a playing surface having an elongated runner section 21 and a scoring area 22 each having a slick surface on which a puck can glide.

The runner section 21 can take the shape of an elongated rectangle having an opening 21*a* at a first end and a wall 24 extending along a portion of both sides of the runner. As will be described below in more detail, a player can stand along the opening 21*a* and slide a puck 10 down the length of the runner 21 and into the scoring area 22 which is positioned on the opposite end of the runner.

In one embodiment, the runner 21 can also include a qualify line 21*c* located adjacent to the scoring area 22, and a play line 21*b* positioned at the termination point of the wall 24 and adjacent to the opening 21*a*.

Figure 3:
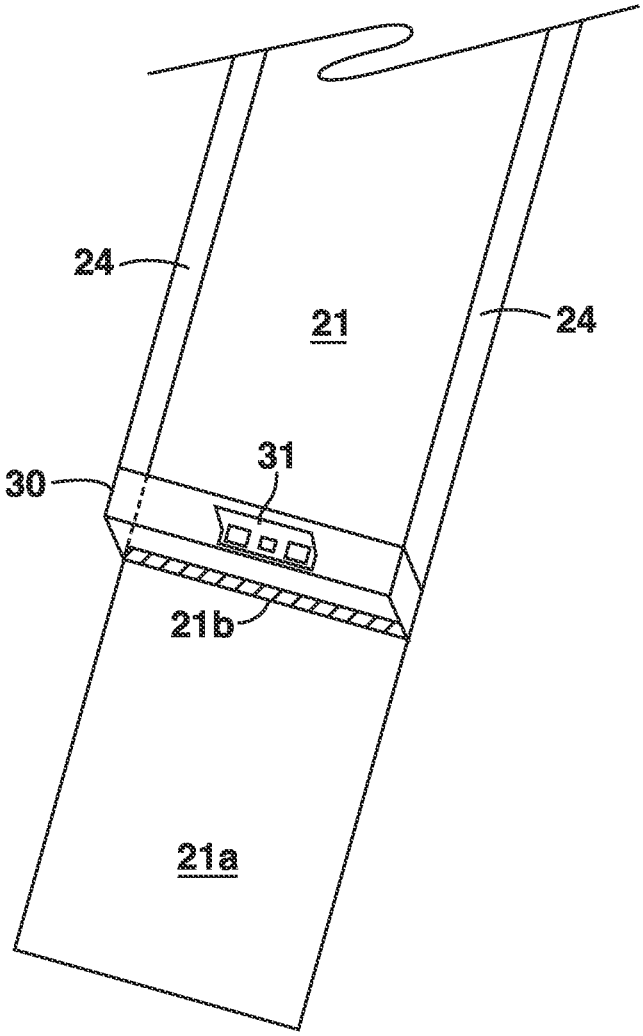
FIG. 3 illustrates a plan view of a table according to another embodiment of the present invention.

FIG. 3 illustrates one alternate embodiment of a playing table 20, which includes an optional play line barrier 30 positioned above the play line 21*b*. In one embodiment, barrier 30 can be secured to each side of the wall 24 so as to be securely fastened to the table. Such a feature can act to physically prevent a player from releasing the puck at a location beyond the play line by requiring the puck to pass beneath the barrier. To this end, play line barrier 30 can be constructed from virtually any type of rigid or semi-rigid material such as a board or a plastic tube extending across the playing surface. Additionally, the barrier 30 can further include foam padding or a rubber liner (not shown) positioned along a periphery thereof to prevent injury to a player when making contact with the barrier.

In another embodiment, play line barrier 30 can further include an optional score keeper 31 capable of keeping a running score of the game and/or a tally of the number of games previously won and lost. As such, score keeper 31 can include components ranging from a mechanical instrument that is manually operated to a fully electronic device with an integrated memory and sound system, for example. As each of these items are well known in the art, no further description is provided.

Returning to FIG. 2, in one embodiment, the scoring area 22 can take the shape of a rectangular element positioned perpendicular to the runner 21 and can include a plurality of scoring marks 25*a*-25*i* positioned thereon. As shown, scoring marks 25*a*-25*i* can take a variety of shapes and sizes.

In one preferred embodiment, both the runner section 21 and the scoring area 22 can be constructed from polystyrene, however other materials such as nylon, plastic, wood or laminate, for example are also contemplated. Moreover, in one alternate embodiment, the runner 21 and scoring area 22 can be made from different materials each having a different coefficient of friction. Such a feature can thus affect the path of the puck during game play in order to increase the challenge to the player.

In another embodiment, table 20 can further include a plurality of lighting elements (backlights) 29 positioned throughout the playing area. In one preferred embodiment, backlights 29 can include a series of LED lights positioned along the wall 24 in order to illuminate the playing surface, however other light types and locations are also contemplated. For instance, one or more of the scoring areas 25*a*-25*i* can also include a lighting element 29 positioned so as to illuminate that particular scoring area.

Additionally, table 20 can further include one or more bumpers 23 positioned along both the runner 21 and the scoring area 22. Bumpers 23 can act to deflect the motion of the puck 10 during game play. As illustrated above in FIG. 2, bumpers 23 can take a variety of shapes including triangles, circles and squares, among others. To this end, virtually any shape can be utilized, and each bumper 23 can be constructed from a variety of materials including plastic and rubber, for example. As such, a single table 20 can include a plurality of bumpers 23 each having the same shape or multiple shapes.

In one alternate embodiment, bumpers 23 can be removably secured to table 20 such that a user can chose the type, number and location of bumpers 23 for each game. Several non limiting examples of materials suitable for removably securing a bumper 23 to a table 20 can include VELCRO, magnetic elements or compression fittings such as snaps, for example. As each of these elements are well known in the art, no further description will be provided.

Figure 4:
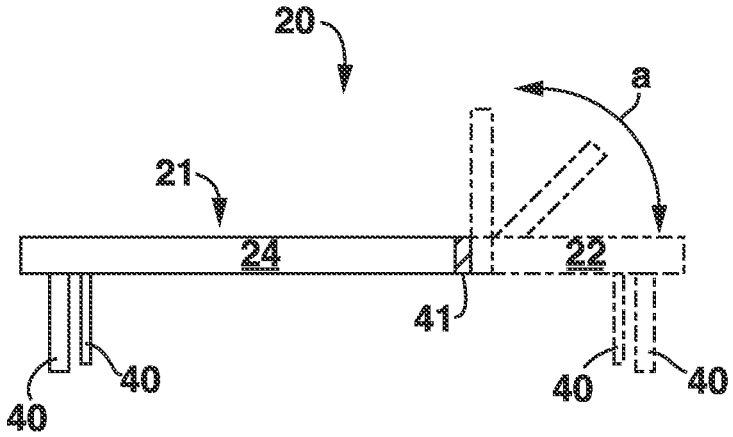
FIG. 4 illustrates a side view of a table according to an alternate embodiment of the present invention.

FIG. 4 illustrates an alternate embodiment of a table 20 that includes collapsible legs 40 and the ability for the table to fold. As shown, the runner 21 and scoring area 22 can be connected via a connection unit 41 in order to allow the table to fold upward for easy storage, as shown by arrow a. As described herein, a connection unit 41 can include any number of known mechanisms for connecting two elements together, including for example, a hinge, latch or other similar hardware.

Figure 5C:
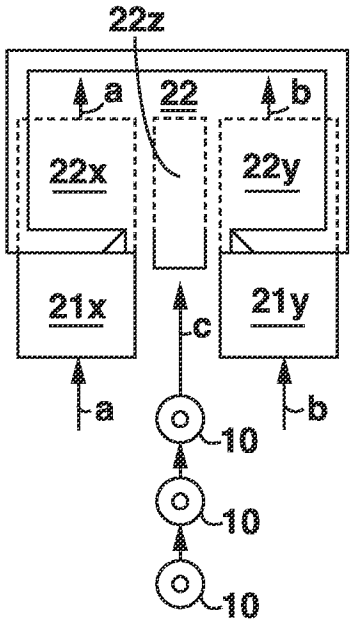
FIG. 5*c* illustrates a plan view of the scoring section of a table according to an alternate embodiment of the present invention.
Figure 5B:
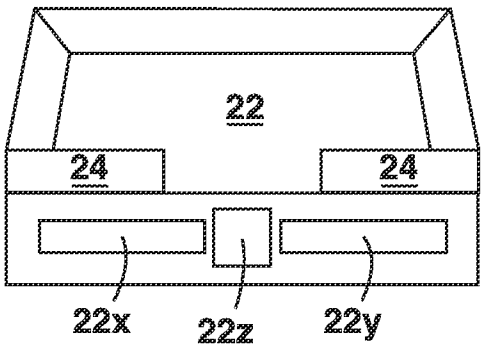
FIG. 5*b* illustrates a side view of the scoring section of a table according to an alternate embodiment of the present invention.
Figure 5A:
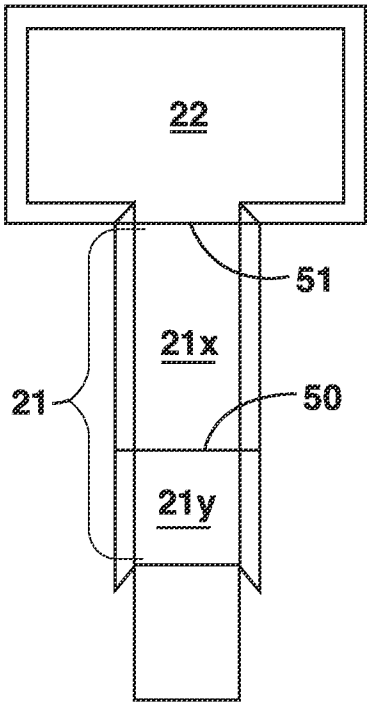
FIG. 5*a* illustrates a top view of a table according to an alternate embodiment of the present invention.

FIGS. 5*a*-5*c* illustrate another alternate embodiment in which the table 20 can be easily and quickly disassembled into a compact unit for easy storage and/or transport. As shown in FIG. 5*a*, runner 21 can include two or more individual segments (21×, and 21*y*) joined together at a first seam 50. Additionally, runner segment 21*x* can also be removably connected to the scoring area 22 via a second seam 51. Moreover, the scoring area 22 can further include several openings 22*x*, 22*y* and 22*z* (See FIG. 5*b*) for storing components of the table and game. To this end, and as illustrated in FIG. 5*c*, the individual runner sections 21*x* and 21*y* can be placed into openings 22*x* and 22*y* (See arrows a and b) and any additional components such as the pucks 10, for example can be placed into opening 22*z* as shown by arrow c.

As used herein, table segments can be joined using any known methodology and hardware such as tongue and grove connections, compression fittings such as a latch or pegs among others. Additionally, openings 22*x*, 22*y* and 22*z* may further include doors or other enclosure mechanisms for keeping the contents placed therein securely fastened. Finally, although illustrated as two distinct runner sections (21*x* and 21*y*) and 3 distinct openings (22*x*, 22*y* and 22*z*), one of skill in the art will readily understand that this is for illustrative purposes only, as multiple components and/or openings can be utilized without deviating from the scope of the inventive concepts disclosed herein. Accordingly, by including the above noted features, a table 20 as described herein can be easily transported for play during picnics, tailgates and parties, for example.

Game Play

The description below illustrates one method of playing Knockilus utilizing the puck and playing table described above. As would be known to one of skill in the art, many modifications and alterations to the preceding description can be employed without deviating from the scope and spirit of the inventive concepts disclosed herein.

To play the game, each player or team can begin with seven pucks 10 and seven slides (also called throws). Each throw can be both offensive and/or defensive in nature. All pucks must be released by the throw line 21*b*, and each released puck must pass the qualify line 21*c*. Any puck that does not pass the qualify line is removed from play for the remainder of the round.

There are nine scoring marks 25*a*-25*i*, including: four 1 point areas, two 3 point areas and three 4 point areas. Each of these scoring areas are designated by a number and a color. In the event that a puck is in a questionable scoring position, the player can look through the hole 13 in the puck to identify what color is shown in order to assign a score for that puck.

Each team throws one puck at a time followed by the opposing team. Each team member must participate and throw on their turn in the rotation.

Each throw can act to score points for your team or to knock the opposing teams puck out of scoring position. Once all pucks have been thrown, the score is tallied and a winner for this round is declared based on the team having the highest score. The team scoring the least amount of points in the previous round will throw first in the next round, thus giving the winning team the last throw in the next round. Having the final throw gives a significant strategic advantage and is thus the reward for winning the previous round.

In one alternative method of play, each round is played to 22 total points. The first to reach 22 points or more after all eligible pucks have been thrown has won the round, and a winner is declared once they have won 2 rounds or once a team has won 2 rounds more than the opponent. In the event that both teams score the same amount of points, the round is considered to be forfeited and new round replaces it. A winner must be declared in order for the round to count.

Game Play Example

Figure 6A:
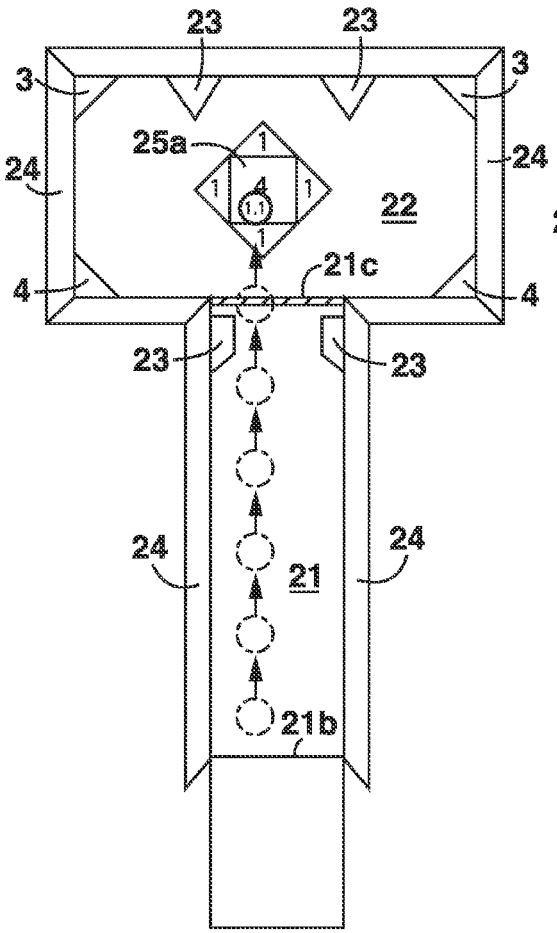
FIG. 6*a* illustrates a game play example according to one embodiment of the present invention.
Figure 6B:
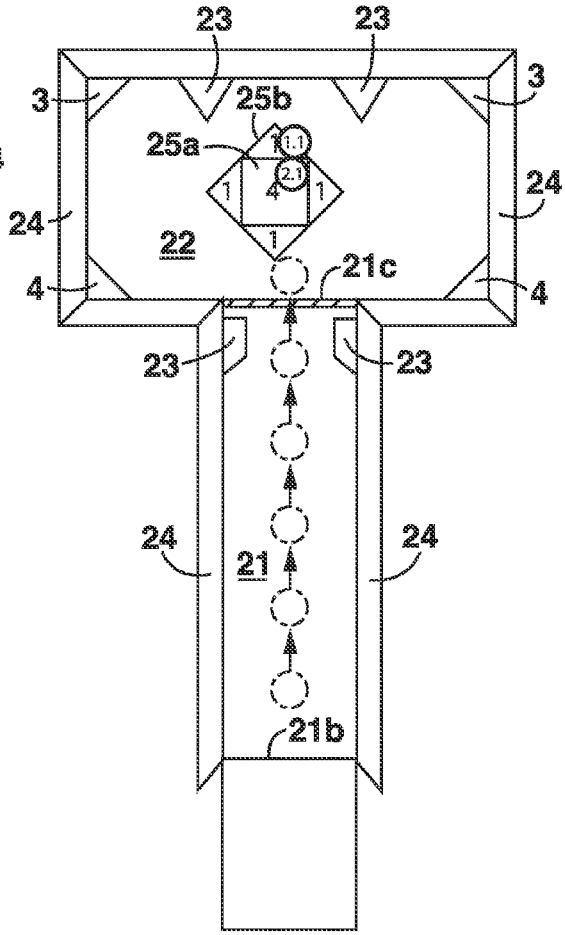
FIG. 6*b* illustrates a game play example according to another embodiment of the present invention.

The game can be further understood by an actual example of play as illustrated in FIGS. 6*a*-6*b*.

As shown in FIG. 6*a*, a first team can slide a first puck 1.1 across the runner section 21 into the scoring area 22. Because the majority of puck 1.1 is located in the scoring mark 25*a*, and this mark is designated with a 4, team 1 will receive 4 points at the end of the round if puck 1.1 remains in place.

However, as shown in FIG. 6*b*, if the second team uses their puck 2.1 to dislodge puck 1.1, the result is that team 2 will have 4 points at the end of the round, and team 1 will have 1 point at the end of the round.

Other examples can include: placing your puck in a position where your next throw can be played off your previous throw. For instance, team 1 can position a first puck in a non scoring area, and use their next puck to propel their first puck into a scoring area. These types of strategic throws if played properly can also be used to move multiple pucks into scoring areas or knock the opposition's puck or pucks out of scoring areas.

In another example, teams can use the bumpers or opposing pucks as obstacles to play from. This can benefit teams by placing their pucks in a better position while lessening the opposition's chance to score.

In yet another example, teams can place their puck(s) in positions to protect pucks that are currently in a good scoring or defensive positions. For instance, if you have a well placed shot that has moved your puck into one of the front 3 point scoring positions. You may consider using one of your upcoming pucks to protect this shot. The opposition may attempt to remove your puck from your desired position to better themselves and their score so it's important to protect your plays.

The play of Knockilus is especially useful for the development and practice of motor dexterity in players as skilled movements are required to slide the puck at the correct angle and speed to achieve the desired scoring location. Moreover, it allows all players to keep a running mathematical score that can change with each throw of the puck. Accordingly, Knockilus incorporates educational, physical and logic based functions into a game that is fun for players of all ages, skill levels and handicaps.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A table game comprising:

a table top having an upwardly facing planar playing surface, said table top being separable into a runner section and a scoring section, each having a different shape;

wherein said runner section includes an opening at a first end opposite to the scoring section, a play line located next to said opening, and a qualify line located next to the scoring section;

a peripheral wall surrounding the scoring section and at least a portion of the runner section;

a plurality of pucks each configured to slide across the playing surface from the opening of the runner section into the scoring section, each of said pucks having a circular shape and including an indented section positioned along a bottom side and a hole extending from a top center portion through the indented bottom side;

a plurality of bumpers configured to alter a path of the puck, said bumpers being located on at least one of said runner section and said scoring section; and a plurality of scoring indicators located on the scoring section.

2. The table game of claim 1, further comprising:

a play line barrier positioned atop the peripheral wall and located above the play line, said barrier being configured to allow a puck to pass beneath.

3. The table game of claim 1, wherein said scoring indicators include a plurality of different shapes and colors.

4. The table game of claim 1, wherein said bumpers include a plurality of different shapes.

5. The table game of claim 4, wherein said bumpers are removably secured to at least one of said runner section and said scoring section.

6. The table game of claim 1, wherein said runner section and said scoring section are constructed from different materials each having a different coefficient of friction.

7. The table game of claim 1, further comprising:

a connection unit configured to removably connect the runner section and the scoring section together.

8. The table game of claim 7, wherein the runner section is separable into a plurality of individual runner segments.

9. The table game of claim 8, wherein a plurality of openings are positioned along an outside periphery of the scoring section, said openings being configured to enclose the plurality of runner segments and one or more pucks.

10. The table game of claim 7, wherein said connection unit is configured to rotate the runner section with respect to the scoring section.

11. The table game of claim 7, wherein said table game is collapsible for easy storage.

12. The table game of claim 1, further comprising:

a plurality of collapsible legs positioned along a bottom side of the table top and extending downward, said legs being configured to allow the table game to stand upright.

13. The table game of claim 1, further comprising:

a printed set of rules for informing a user to assemble the table and play a game.

14. The table game of claim 1, further comprising:

a plurality of lighting elements configured to illuminate the playing surface.

15. The table game of claim 14, wherein at least one lighting element is configured to illuminate a particular scoring indicator.

16. The table game of claim 1, further comprising:

a mechanical score keeping unit configured to manually display a game score.

17. The table game of claim 1, further comprising:

an electrical score keeping unit configured to electronically display a game score.

18. A method of playing a table game utilizing a table top, a plurality of pucks and a plurality of bumpers, said method comprising:

selecting two players, wherein a player includes at least one of an individual or a group of individuals;

providing each player seven pucks and seven throws, wherein each player alternates throws;

instructing each player to stand along an opening of a runner section when it is their turn to throw;

sliding a puck along the runner section such that the puck strikes at least one of a scoring indicator, an opposing players puck and a bumper;

wherein if a puck does not cross a qualify line, said puck is removed from play, and if a puck is released after a play line, said puck is removed from play;

counting a score for each player; and declaring a winner.

19. The method of playing a table game of claim 18, further comprising:

looking through a hole in the puck to determine a score for each throw.

* * * * *